US010703522B2

(12) United States Patent
Harth et al.

(10) Patent No.: US 10,703,522 B2
(45) Date of Patent: Jul. 7, 2020

(54) METHOD FOR FORMING AND FILLING SPOUT FILM BAGS AND DEVICE THEREFOR

(71) Applicant: INDAG Pouch Partners GmbH, Eppelheim (DE)

(72) Inventors: Rolf Harth, Neckargemünd (DE); Frank Lechert, Weinheim (DE)

(73) Assignee: INDAG POUCH PARTNERS GMBH, Eppelheim (DE)

( * ) Notice: Subject to any disclaimer, the term of this patent is extended or adjusted under 35 U.S.C. 154(b) by 234 days.

(21) Appl. No.: 15/750,800

(22) PCT Filed: Aug. 5, 2016

(86) PCT No.: PCT/EP2016/068745
§ 371 (c)(1),
(2) Date: Feb. 6, 2018

(87) PCT Pub. No.: WO2017/025459
PCT Pub. Date: Feb. 16, 2017

(65) Prior Publication Data

US 2018/0229875 A1 Aug. 16, 2018

(30) Foreign Application Priority Data

Aug. 7, 2015 (EP) ..... 15180141

(51) Int. Cl.
*B65B 43/36* (2006.01)
*B65B 55/02* (2006.01)
(Continued)

(52) U.S. Cl.
CPC ..... *B65B 43/36* (2013.01); *B65B 3/045* (2013.01); *B65B 31/042* (2013.01); *B65B 43/50* (2013.01);
(Continued)

(58) Field of Classification Search
CPC ..... B65B 3/045; B65B 43/36; B65B 43/50; B65B 43/54; B65B 43/60; B65B 55/022
(Continued)

(56) References Cited

U.S. PATENT DOCUMENTS 3,775,945 A * 12/1973 Kuhnle ..... B65B 43/36 53/385.1
4,180,105 A * 12/1979 Harvey ..... B65C 3/26 141/165
(Continued)

FOREIGN PATENT DOCUMENTS

DE 3922779 A1 * 1/1991 ..... B65B 3/045
DE 102006035963 A1 * 2/2008 ..... B65B 55/022
(Continued)

OTHER PUBLICATIONS

JPO machine translation JP 2001-058602, retrieved from JPO website, https://www.j-platpat.inpit.go.jp/, Nov. 21, 2019, 14 pages. (Year: 2019).*
(Continued)

*Primary Examiner* — Stephen F. Gerrity
(74) *Attorney, Agent, or Firm* — Mayer Brown LLP

(57) ABSTRACT

An apparatus and method for forming and filling spout film bags which are transferred by a transfer wheel including blowing nozzles, to a filler arranged downstream of the transfer wheel. A blowing nozzle can be placed on the spout upper edge of the spout of a spout film bag and then a defined pressure pulse can be introduced into the interior of the spout film bag through the spout by the blowing nozzle to form the spout film bag. The apparatus can include a transfer wheel having a plurality of receiving stations and blowing nozzles assigned to the receiving stations, the blowing nozzles being able to be placed on the spout upper edges of the spouts in order to introduce a defined pressure pulse, and a filler, arranged downstream of the transfer wheel, for filling the formed spout film bags.

7 Claims, 3 Drawing Sheets

(51) Int. Cl.

| | |
|---|---|
| ***B65B 57/02*** | (2006.01) |
| ***B65B 59/02*** | (2006.01) |
| ***B65B 3/04*** | (2006.01) |
| ***B65B 31/04*** | (2006.01) |
| ***B65B 43/50*** | (2006.01) |
| ***B65B 43/60*** | (2006.01) |

(52) U.S. Cl.
CPC ..... *B65B 43/60* (2013.01); *B65B 55/022* (2013.01); *B65B 57/02* (2013.01); *B65B 59/02* (2013.01)

(58) Field of Classification Search
USPC ..... 53/459, 570, 384.1, 385.1
See application file for complete search history.

(56) References Cited

U.S. PATENT DOCUMENTS

| | | | | |
|---|---|---|---|---|
| 5,722,221 | A | 3/1998 | Maltman et al. | |
| 6,244,307 | B1 * | 6/2001 | Araki et al. | B65B 43/50 141/10 |
| 6,499,280 | B1 * | 12/2002 | Tsutsui | B65B 43/52 141/169 |
| 8,234,841 | B2 * | 8/2012 | Wild et al. | B65B 43/36 53/434 |
| 2008/0041018 | A1 * | 2/2008 | Stephenson | B65B 3/045 53/449 |
| 2012/0008884 | A1 * | 1/2012 | Murray | B65B 43/50 383/104 |

FOREIGN PATENT DOCUMENTS

| | | | | |
|---|---|---|---|---|
| JP | 2001058602 | A | 3/2001 | |
| WO | 2005/100164 | A1 | 10/2005 | |
| WO | WO-2008088327 | A1 * | 7/2008 | B65B 43/36 |
| WO | WO-2009136662 | A1 * | 11/2009 | B65B 43/50 |

OTHER PUBLICATIONS

Extended European Search Report dated Dec. 14, 2015 in European Patent Application No. 15180141.2.

* cited by examiner

METHOD FOR FORMING AND FILLING SPOUT FILM BAGS AND DEVICE THEREFOR

CROSS-REFERENCE TO RELATED APPLICATIONS

This application is a U.S. national stage entry of International Application No. PCT/EP2016/068745, filed Aug. 5, 2016, which claims priority to European Application No. 15180141.2, filed Aug. 7, 2015, the contents of both of which are incorporated by reference herein in their entirety.

BACKGROUND OF THE INVENTION

1. Field of the Invention

The invention relates to a method for forming and filling spout film bags and to a device for forming and filling spout film bags.

2. Description of Related Art

It is well known that film bags to be filled with a filling product are provided in a folded state prior to the filling process. In order to enable the filling of these film bags during a filling process, the film bags are previously formed or brought into shape, thereby providing a cavity in their interior, that is, between the two film bag halves that configure the film bag, wherein the cavity may be filled with the filling product. Generally, the film bags are formed or shaped by introducing air or sterilizing gas, thereby, however, encountering the situation that not all of the film bags may be formed or shaped in the same manner.

SUMMARY OF THE INVENTION

It is the object of the invention to provide a method for forming and filling spout film bags and a device therefor, which enable a defined forming or shaping of the spout film bags.

The object is solved by a method and a device as described herein. Preferred embodiments and variants are also disclosed.

In the method for forming and filling spout film bags, the spout film bags are fed to a filler by means of a transfer wheel that includes blowing nozzles and is positioned upstream of the filler, wherein a respective blowing nozzle is placed on the spout upper edge of the spout of a spout film bag and thereafter a defined pressure pulse is introduced through the spout into the interior of the spout film bag by means of the blowing nozzle so as to form or shape the spout film bag.

By placing the blowing nozzle on the spout upper edge, a substantially air tight sealing with respect to the environment is obtained such that the pressure pulse introduced into the spout film bag by the blowing nozzle is substantially received within the interior of the spout film bag without loss, since leakage into the environment is avoided. In this manner, inflation of any of the spout film bags may be performed under identical conditions, since the same defined pressure pulse is applied to all of the spout film bags. This leads to the same final result of the inflation process for all of the spout film bags.

Prior to placing the blowing nozzle on the spout upper edge, the spout of the spout film bag may be received in a receiving station of the transfer wheel that includes a plurality of receiving stations, wherein the receiving station is associated with or assigned to a blowing nozzle.

Forming or shaping of the spout film bag precedes the filling product in the filler. The filling product may at least approximately represent liquid food, such as beverages or pulp, or may represent approximately liquid animal food, such as cat milk or canned food.

A spout film bag may represent a film bag of very different types provided with a screwable reclosable system, for instance, a screw cap. In particular, spout film bags may include or comprise different fill volumes, film bag formats and/or film bag materials.

The forming or shaping of the spout film bag by means of a defined pressure pulse may result in a defined form or shape of the spout film bag, i.e., it may have a defined cavity in its interior that may be filled with the filling product. Since the transfer wheel comprises a plurality of receiving stations with associated blowing nozzles for the forming or shaping of spout film bags, any of these spout film bags may take on the same defined shape or form and also the same defined cavity in their interior after having undergone the forming or shaping process.

A magnitude of the defined pressure pulse may be calculated on the basis of type information of the spout film bag, such as fill volume, film bag format and/or film bag material, wherein the magnitude comprises an indication regarding the time period of inserting the pressure pulse and an indication regarding the amount of a medium to be inserted. Such a magnitude calculated on the basis of type information may also be referred to as target magnitude. The magnitude of the defined pressure pulse is relevant for the defined form or shape that is obtained and for the defined cavity obtained in the interior of the spout film bag. If a spout film bag to be formed is made of a film material of reduced thickness compared to a spout film bag that has already been formed or shaped, a defined pressure pulse of reduced magnitude is sufficient for the spout film bag still to be formed compared to the already formed spout film bag in order to generate a defined form or shape and a defined cavity during the forming process.

Using the same film material for a small and a large spout film bag, respectively, requires a reduced magnitude of the pressure pulse for the small spout film bag compared to the large spout film bag in order to generate a defined form and a defined cavity during the forming process. For calculating the magnitude of the pressure pulse, an evaluation and control unit may be provided, wherein the type information may be input and/or may be read from data storage.

Furthermore, the blowing nozzle may be controlled by the evaluation and control unit, thereby introducing the defined pressure pulse into the interior of the spout film bag with the calculated magnitude. Providing the blowing nozzle as a controllable nozzle provides for the possibility that upon a change of the type of spout film bag, as may be determined or recognized from the type information of the spout film bag, the magnitude of the pressure pulse for a forming process be changed in a simple manner in order to always obtain spout film bags after the forming process that are formed in defined manner.

The spout film bag may be supplied to the filler by means of the transfer wheel after the forming process of the spout film bag and the spout film bag may be filled in the filler.

A device for forming and filling spout film bags and for performing the method as discussed above or described below, comprises a transfer wheel including a plurality of receiving stations and blowing nozzles assigned to the receiving stations that may be placed on the spout upper edge of the spouts for introducing a defined pressure pulse, and the device further comprises a filler downstream of the transfer wheel for filling the received spout film bags. The spout film bags may be received by the receiving stations and may be formed or shaped by means of the blowing nozzles assigned to the receiving stations by introducing gas with a pressure pulse into the interior.

The device may further comprise an evaluation and control unit configured to calculate a magnitude of the pressure pulse on the basis of type information of the spout film bag, such as fill volume, film bag format and/or film material, wherein the magnitude comprises an indication regarding the time period for the duration of the introduction of the pressure pulse and an indication regarding the amount of a medium to be introduced. In order to provide the possibility of enabling the forming or shaping of different types of spout film bags with a single device for forming spout film bags, it is advantageous when a magnitude of the pressure pulse may be adapted to the respective type of spout film bag. Therefore, for calculating the magnitude of the pressure pulse, the fill volume, the film bag format and/or the film material may be taken into consideration.

The evaluation and control unit may be further configured to control a blowing nozzle, thereby enabling the introduction of a defined pressure pulse with a calculated magnitude, i.e., target magnitude, into the interior of the spout film bag. By means of the evaluation and control unit, all of the blowing nozzles of the plurality of receiving stations of the transfer wheel may be accordingly controlled. By controlling the blowing nozzle, there is the possibility to easily adapt the magnitude of the pressure pulse for a forming process upon the change in type of spout film bag, so that for a single device for forming spout film bags, different types of spout film bags may be formed or shaped.

One end of the blowing nozzles may be configured so as to enable placement on the spout upper edge of the spout of a spout film bag and to introduce the defined pressure pulse through the one end and through the spout into the spout film bag.

Optionally, a sterilization wheel may be positioned between the filler and the transfer wheel.

BRIEF DESCRIPTION OF THE DRAWINGS

For a better understanding and for illustration purposes, aspects of the invention are illustrated in the attached figures in an exemplary manner.

In the figures.

DETAILED DESCRIPTION OF THE INVENTION

Figure 1:
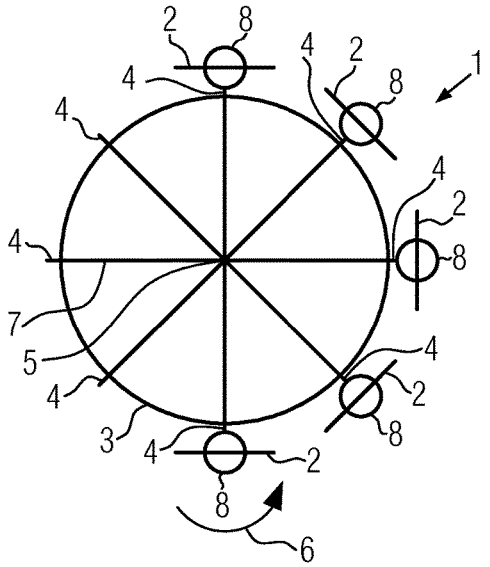
FIG. 1 is a top view of a device for forming spout film bags.

FIG. 1 illustrates a top view of the device 1 for forming spout film bags 2. A transfer wheel 3 comprises a plurality of receiving stations 4, of which eight stations are shown in this case. The transfer wheel 3 is configured to be rotatable around an axis 5 in at least one first direction 6. The device 1 comprises a support or leverage 7, attached to which are blowing nozzles—not shown here—used for forming or shaping the spout film bags 2. In this case, a respective one of the blowing nozzles is assigned to a respective one of the receiving stations 4. Optionally, one blowing nozzle may comprise a plurality of nozzle openings. In order to introduce a defined pressure pulse into the interior of a spout film bag 2, the blowing nozzle is placed on the spout upper edge. At five of the receiving stations 4 there are schematically illustrated spout film bags 2 received therein, wherein each one of the receiving stations 4 has received a spout 8 of a spout film bag 2.

Figure 2:
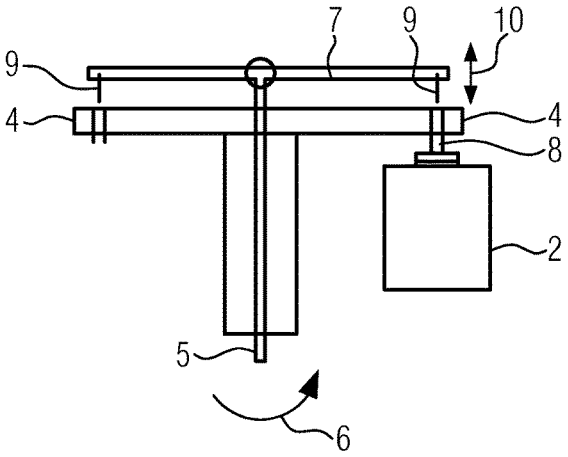
FIG. 2 is a side view of the device for forming spout film bags.
Figure 3A:
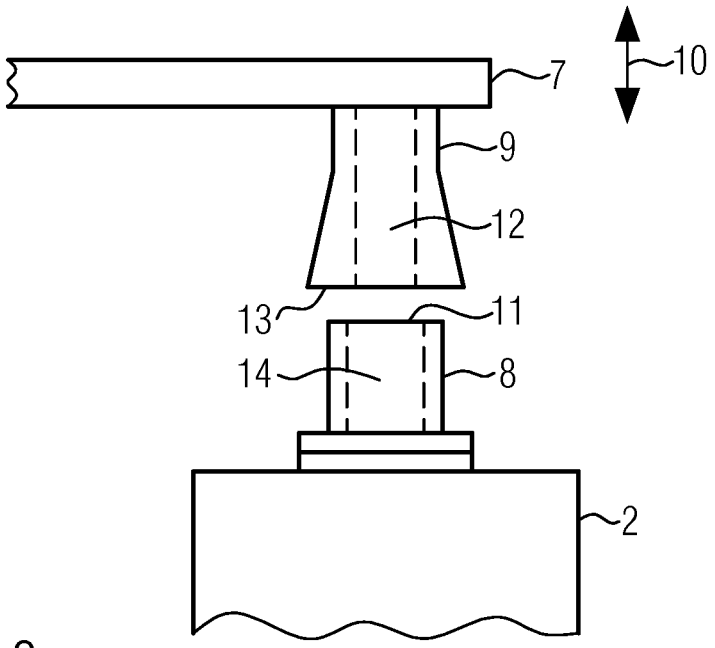
FIG. 3*a* is a schematic view of a blowing nozzle and a spout.
Figure 3B:
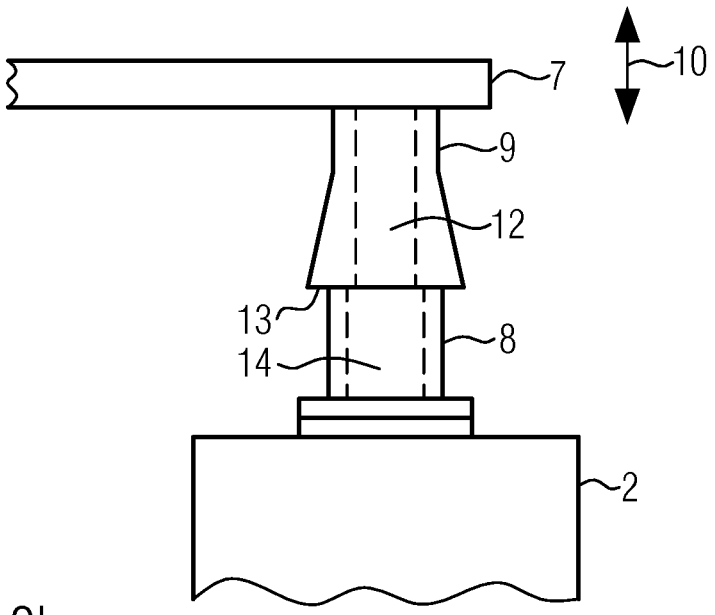
FIG. 3*b* is a schematic view of a blowing nozzle placed on a spout upper edge.

FIG. 2 illustrates a side view of the device 1 for forming spout film bags 2. A respective one of the blowing nozzle 9 is assigned to each of the two illustrated receiving stations 4. The blowing nozzles 9 are movable in a vertical direction 10 by means of the support or leverage 7 on which they are mounted such that the blowing nozzles 9 may be placed on the spout upper edge of the respective spouts 8. Here, the blowing nozzles 9 are illustrated in a schematic manner only. Their configuration is so as to enable their placement on the spout upper edge of a spout 8 so that the defined pressure pulse may be introduced into the spout film bag 2. FIGS. 3*a* and 3*b* are detailed views in this respect. After the placement of a blowing nozzle 9 on the spout upper edge of a spout 8, gas and/or any other substance is introduced into the interior of the spout film bag 2 in the form of a pressure pulse, thereby obtaining a forming or shaping of the spout film bag 2, wherein a defined form or shape of the spout film bag 2 and a defined cavity in the interior of the spout film bag 2 are obtained.

The blowing nozzles 9 associated with the respective receiving stations 4 are arranged on the leverage 7 that may be rotated together with the transfer wheel 3 around the rotation axis 5 so that a blowing nozzle 9 assigned to a receiving station 4 is moved together with this receiving station 4 by rotating the transfer wheel 3.

FIG. 3*a* shows the relative arrangement of a nozzle 9 and a spout 8 of a spout film bag 2. For a better visualization, the respective receiving station 4 is not illustrated. The blowing nozzle 9 is movable in the vertical direction by means of the leverage 7 and may thus be placed on the spout upper edge 11. The illustrated blowing nozzle 9 comprises a passage 12 for the defined pressure pulse. In the area 13 of the blowing nozzle 9 that is in contact with the spout upper edge 11, the blowing nozzle 9 may protrude from the spout 8, that is, the outer diameter of the blowing nozzle 9 in the area 13 is greater than the outer diameter of the spout 8. In this manner, placement of the blowing nozzle 9 on the spout upper edge 11 results in a substantially tight sealing with respect to the environment, so that the pressure pulse introduced into the spout film bag 2 by the blowing nozzle 9 is substantially received in its entirety in the interior of the spout film bag 2, since leakage into the environment is suppressed.

It may also be contemplated that the outer diameter of the blowing nozzle 9 in the area 13 substantially corresponds to the outer diameter of the spout 8 or is substantially equal thereto.

It is also contemplated that the blowing nozzle 9 further comprises an alignment device in the area 13, for instance, a protruding circular hollow cylinder that may be at least partially inserted into the interior 14 of the spout 8. To this end, the circular hollow cylinder has preferably a diameter that is less than the inner diameter of the spout 8 so that, for instance, a clearance of 0.5 mm is obtained.

FIG. 3*b* shows a schematic view of the blowing nozzle 9 placed on the spout upper edge 11. In the area 13 of the blowing nozzle being seated on the spout upper edge 11, the blowing nozzle 9 protrudes from the spout 8. The passage 12 in the blowing nozzle 9 for the defined pressure pulse is arranged above the interior 14 of the spout 8 such that the defined pressure pulse may be introduced into the spout film bag 2 without leaking into the environment.

Figure 4:
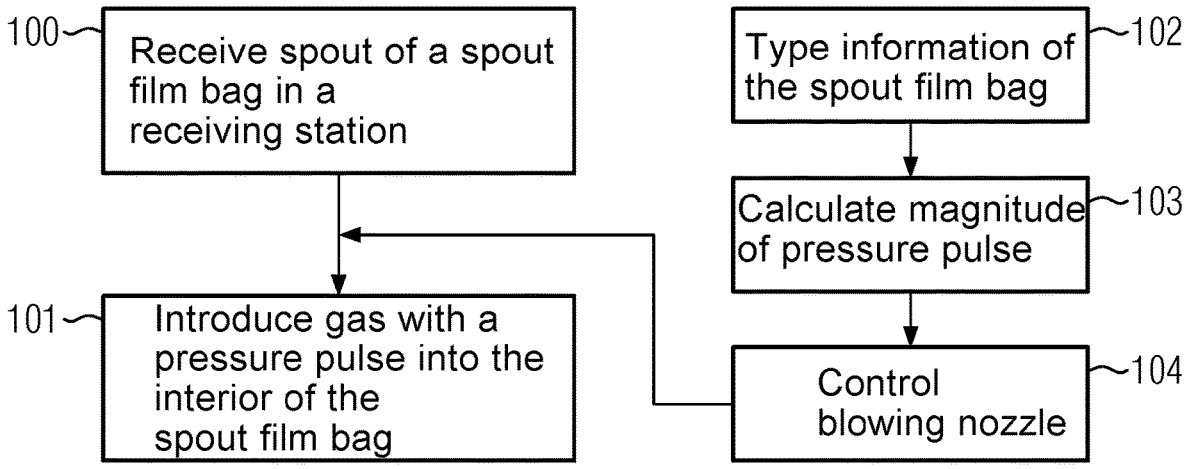
FIG. 4 is a method for forming or shaping spout film bags.

FIG. 4 illustrates a flow chart of a method for forming spout film bags. In step 100, a spout of a spout film bag is received by a receiving station of the device for forming spout film bags as described above. By means of a blowing nozzle associated with or assigned to the receiving station, a gas is introduced into the interior of the spout film bag with a pressure pulse in step 101. For introducing the pressure pulse into the interior of the spout film bag, the blowing nozzle is placed on the spout upper edge. Since it may be required to differently configure the magnitude of the pressure pulse for different types of spout film bags so as to obtain a target form or shape of the spout film bag, in step 102, type information of the spout film bag may be input into an evaluation and control unit and/or may be read out from a data storage. Based on this type information, a magnitude of the pressure pulse is calculated in step 103. In step 104, the blowing nozzle is controlled by the evaluation and control unit, thereby enabling the control of the magnitude of the pressure pulse that is used in step 101.

While there have been shown and described fundamental novel features of the invention as applied to the preferred and exemplary embodiments thereof, it will be understood that omissions and substitutions and changes in the form and details of the disclosed invention may be made by those skilled in the art without departing from the spirit of the invention. Moreover, as is readily apparent, numerous modifications and changes may readily occur to those skilled in the art. Hence, it is not desired to limit the invention to the exact construction and operation shown and described and, accordingly, all suitable modification equivalents may be resorted to falling within the scope of the invention as claimed. It is the intention, therefore, to be limited only as indicated by the scope of the claims appended hereto.

The invention claimed is:

1. A method for forming and filling spout film bags supplied via a transfer wheel comprising blowing nozzles to a filler positioned downstream of the transfer wheel characterized in that a respective one of the blowing nozzles is placed on the spout upper edge of the spout of a spout film bag and thereafter, a defined pressure pulse for forming the spout film bag is introduced through the spout into the interior of the spout film bag by means of the blowing nozzle, wherein a magnitude of the defined pressure pulse is calculated on the basis of type information of the spout film bag, such as at least one of fill volume, film bag format, and film material, wherein the magnitude comprises an indication of a time period for the duration of the introduction of the pressure pulse and an indication regarding the amount of a medium to be introduced, and wherein calculating the magnitude is performed by means of an evaluation and control unit, and wherein at least one of inputting the type information and reading out the type information from a data storage is performed.

2. The method of claim 1, in which prior to placing the blowing nozzle on the spout upper edge, the spout of the spout film bag is received at a receiving station of the transfer wheel that includes a plurality of receiving stations, wherein the blowing nozzle is assigned to the receiving station.

3. The method of claim 1, wherein additionally the blowing nozzle is controlled by the evaluation and control unit, thereby introducing the defined pressure pulse having the calculated magnitude into the interior of the spout film bag.

4. The method of claim 1, wherein after forming the spout film bag the spout film bag is supplied by the transfer wheel to the filler downstream thereof and the spout film bag is filled in the filler.

5. A device for forming and filling spout film bags and for performing the method of claim 1, comprising a transfer wheel including a plurality of receiving stations and blowing nozzles assigned to the receiving stations, the blowing nozzles being configured to be placed on spout upper edges of the spout for introducing a defined pressure pulse, the device further comprising a filler downstream of the transfer wheel for filling the formed spout film bags, and further comprising an evaluation and control unit configured to calculate a magnitude of the pressure pulse on the basis of type information of the spout film bag, such as at least one of fill volume, film bag format and film material, wherein the magnitude comprises an indication of a time period for the duration of the introduction of the pressure pulse and an indication regarding the amount of a medium to be introduced.

6. The device of claim 5, wherein the evaluation and control unit is further configured to control the blowing nozzles, thereby enabling the introduction of the defined pressure pulse having the calculated magnitude into the interior of the spout film bag.

7. The device of claim 5, wherein one end of the blowing nozzles is configured to be placeable on the spout upper edge of the spout of a spout film bag, wherein the defined pressure pulse is introducible through the one end and through the spout into the spout film bag.

* * * * *